United States Patent [19]

Woodard

[11] 3,980,015

[45] Sept. 14, 1976

[54] CAN CRUSHING DEVICE

[76] Inventor: Hubert R. Woodard, 1604 E. 60th St., Long Beach, Calif. 90805

[22] Filed: June 2, 1975

[21] Appl. No.: 582,741

[52] U.S. Cl. ..... 100/233; 100/DIG. 2; 100/264

[51] Int. Cl.[2] ..... B30B 7/00

[58] Field of Search ..... 100/DIG. 1, 233, 236, 100/237, 264, 293

[56] References Cited

UNITED STATES PATENTS

| | | | |
|---|---|---|---|
| 1,761,124 | 6/1930 | Guiden | 100/233 |
| 3,667,386 | 6/1972 | Workman | 100/233 |
| 3,766,849 | 10/1973 | Maron | 100/233 |
| 3,776,129 | 12/1973 | Carlson | 100/233 |

*Primary Examiner*—Billy J. Wilhite

*Attorney, Agent, or Firm*—Huebner & Worrel

[57] ABSTRACT

A device for crushing cans having two crushing members having handles, the members being adapted to be moved downwardly onto a can supported on a base member, the crushing members being hinged to opposite ends of the base member. The crushing members first collapse the can ends, and as they are moved farther downwardly, flatten the entire can.

8 Claims, 5 Drawing Figures

CAN CRUSHING DEVICE

BACKGROUND OF THE INVENTION

The invention relates to can crushing devices. In the prior art there have been numerous can crushing devices but they are relatively complicated or require a series of movements or adjustments during which the can is crushed.

The present invention is a very simple structure in which a can is crushed by the movement of two hand operated crushing members. The crushing members are moved simultaneously on hinges through arcs of slightly more than 90°, at the end of which movement the can is crushed to approximately ½ inch thickness or less than one-third of the can diameter.

SUMMARY OF THE INVENTION

According to the present invention, a can is positioned in the crushing device whereby both ends of the can for practical purposes are simultaneously forced downwardly, and whereby thereafter by continuous movement of the crushing members, the remainder of the can is flattened.

It is an object of the invention to provide an improved can crushing device which is simple and inexpensive to manufacture, and which may be easily operated by a relatively young child.

It is another object of the invention to provide a device, as described in the previous paragraphs, in which a can can be positioned in the device for crushing without centering or adjusting of the can.

It is still another object of the invention to provide a device, as described in the previous paragraphs, in which the ends of the cans are crushed just prior to completely crushing the entire can.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes.

DESCRIPTION OF THE PREFERRED EMBODIMENT

Figure 1:
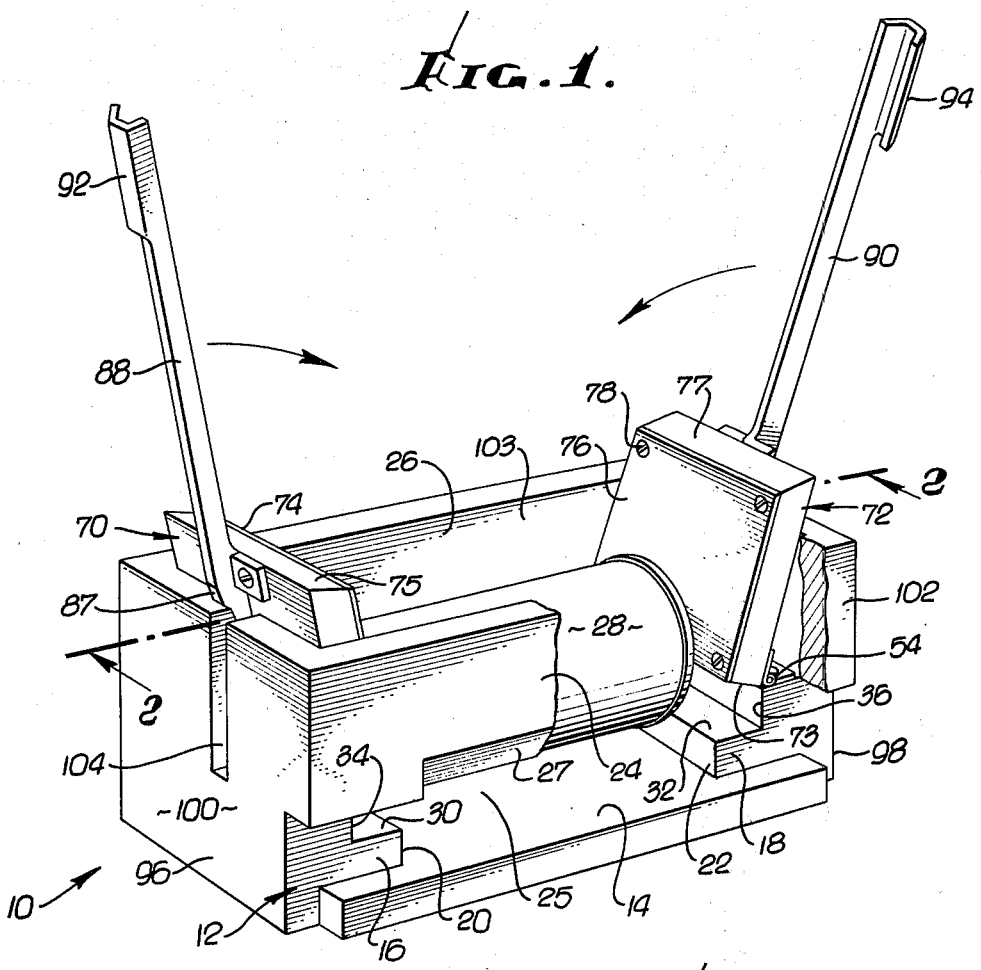
FIG. 1 is a perspective view of the invention with the can in position for crushing, the crushing members being in a raised non-crushing position.

Referring again to the drawings, in FIGS. 1–4 there is shown a can crushing device, generally designated as 10, having a base member 12. The base member has a can supporting surface 14 which extends between two edge members 16 and 18, having edge faces 20 and 22, the edge surfaces and the surface 14 defining a can crushing area.

Extending upwardly from the base member 12 are side walls 24 and 26. The side wall 24 has a horizontal slot 25 therethrough with a bevelled surface 27 at its upper end to permit easy removal of a crushed can out of the side of the device. While the side walls limit the lateral movement of the can they are not absolutely necessary to position the can, in that a can typically when placed on the surface 14 tends not to move, and once the crushing operation has commenced is unable to move laterally. Thus, a can, as 28, is positioned relatively loosely on the surface 14 with respect to the side walls, and its ends are positioned closely adjacent but not necessarily in contact with the edge faces 20 and 22.

The edge members 16 and 18 have horizontal surfaces 30 and 32, respectively, parallel to the surface 14. Extending upwardly from the surfaces 30 and 32 are vertical faces 34 and 36 of hinge strips or supporting members 38 and 40, respectively. The hinge supporting members have hinge surfaces 44 and 46 on which plates 48 and 50 of hinges 52 and 54 are secured by means of screws 56.

Hinge plates 60 and 62 are secured by screws 56 to the upper sides 64 and 66 of crushing members, generally designated as 70 and 72, respectively. Where the crushing members are made of relatively soft material, as wood, their crushing surfaces are formed with metal plates 74 and 76, the plates being secured by means of screws 78.

Figure 2:
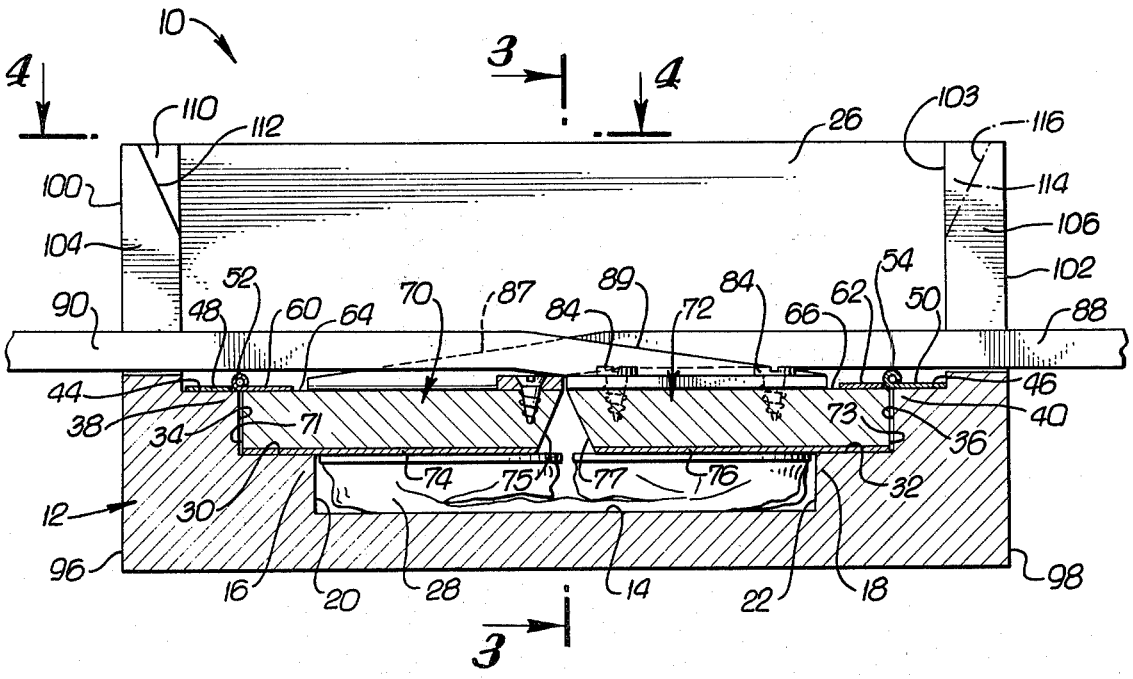
FIG. 2 is a side elevational view of the device illustrating a crushed can and the crushing members in the crushing position, taken substantially along the lines 2—2 of FIG. 1.
Figure 3:
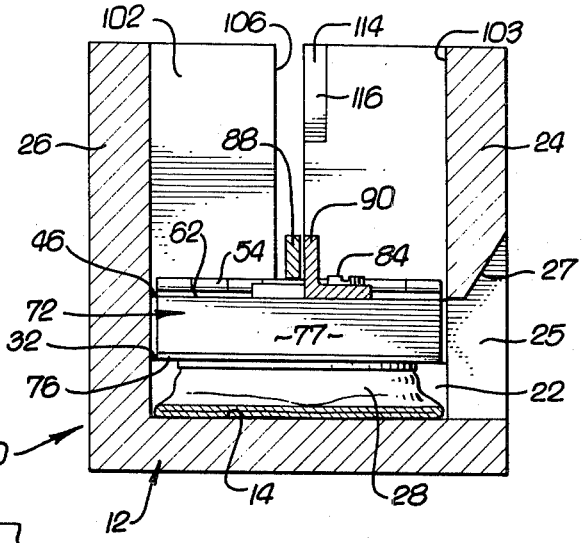
FIG. 3 is a cross-sectional end view taken along the lines 3—3 of FIG. 2.
Figure 4:
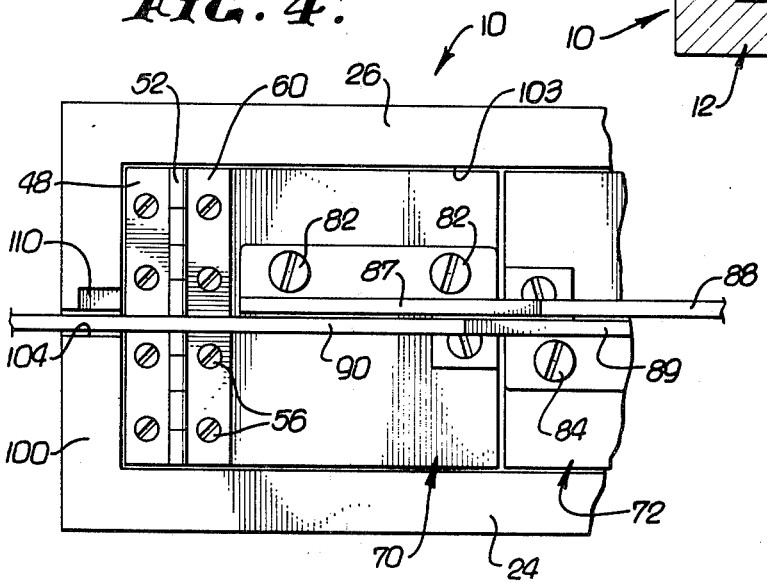
FIG. 4 is a fragmentary plan view taken along the lines 4—4 of FIG. 2.

As shown in FIG. 2 at their outer ends the crushing members have vertical surfaces 71 and 73 in juxtaposition with the surfaces 34 and 36, respectively, of the base member when in the crushing position. In this position the crushing surfaces 74 and 76 are in abutment with or adjacent the horizontal surfaces 30 and 32. The inner ends of the crushing members have chamfered surfaces 75 and 77 to permit the crushing members to move into and out of the crushing position without making contact.

Secured to the upper surfaces 64 and 66 by means of screws 82 and 84 are handle rods 88 and 90, having respective chamfered surfaces 87 and 89 at one end and handles 92 and 94 at the other end. The handles are adapted to be moved by the operator to pivotally actuate the crushing members 70 and 72 from their upper non-crushing position, shown in FIG. 1, to their lower crushing position, shown in FIG. 2, on the pivots provided by the hinges 52 and 54. The rod handles are transversely offset so as to cross without contact in their upward and downward parallel movements and to be juxtaposed in their crushing positions.

Extending upwardly from opposite ends 96 and 98 of the base member 12 are vertical end walls 100 and 102, respectively. The end and side walls define an upper rectangular opening 103. The end walls have vertically extending, upwardly opening slots 104 and 106 which are transversely offset to correspond to the rod handles to permit their entry when they are lowered into the crushing position. Juxtaposed to the slot 104 is a groove 110 having an outwardly slanting surface 112, positioned to receive the chamfered surface 87 on the handle rod 88 in its upper position to permit the crushing member 70 to be moved to an at rest position out of the way of the can area so as to permit the easy entry of a can. Similarly, a groove 114 having a slanting surface 116 is juxtaposed to the slot 106 to permit the chamfered surface 89 of the handle rod 90 to be moved onto the surface 116 when in the noncrushing position.

Figure 5:
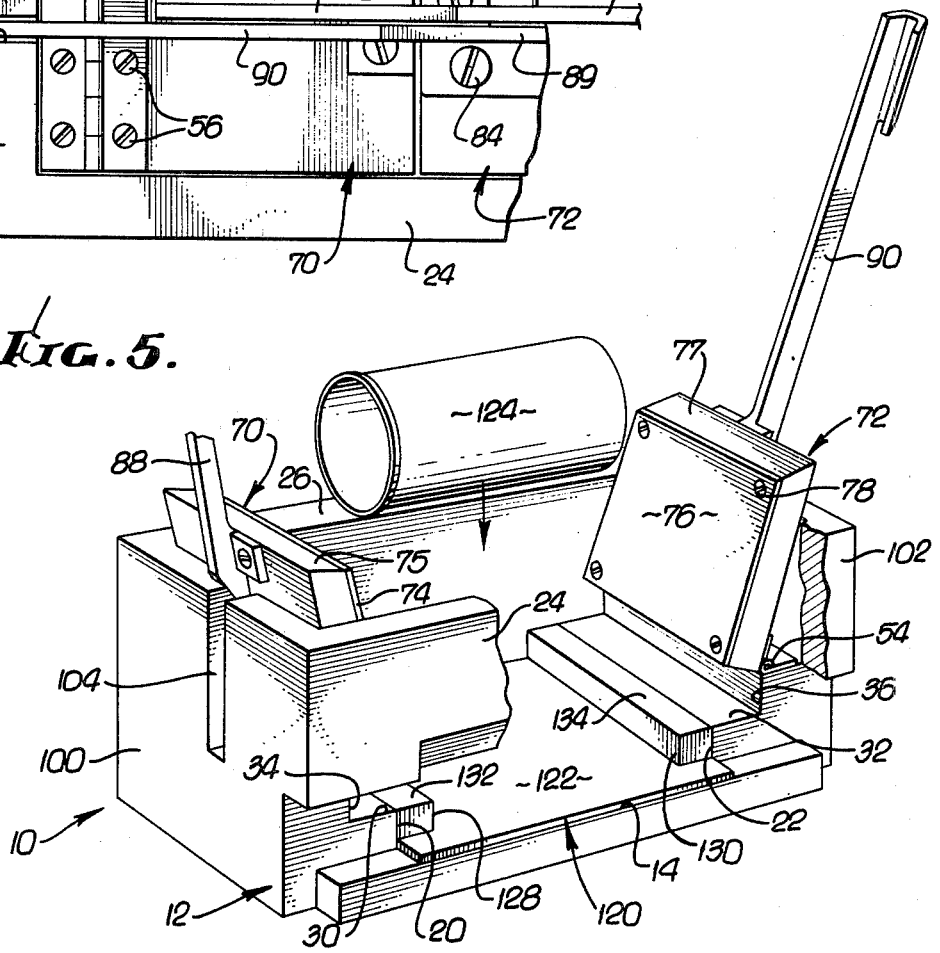
FIG. 5 is the perspective view of the invention illustrating the use of an adapter inserted to receive a can smaller than that shown in FIG. 1.

As shown in FIG. 5, an adapter, generally designated as 120, is fitted on the surface 14 and in abutment with the surfaces 20 and 22. The adapter has a base member 122 on which a can, as 124, is positioned for crushing. Transversely extending strips 128 and 130 are secured on opposite longitudinal ends of the base member 120 and their distance apart is determined by the length of the can to be inserted between them for crushing. The upper surfaces 132 and 134 of the strips 128 and 130, respectively, are flush with the surfaces 30 and 32 so that the crushing members can come down to their normal crushing position. It is not necessary that the crushing members make contact with the surfaces 30 and 32 in the crushing position. However, the can is flattened to the extent that the crushing members move downwardly, as indicated in FIG. 2, where the downward movement is limited by the surfaces 30 and 32.

In operation, having the handles 92 and 94 in their upward position, as shown in FIG. 1, the can of the proper size is dropped onto the surface 14 having its ends adjacent the surfaces 20 and 22. The can need not be precisely centered, but must be positioned so that the crushing members will move against the top of the ends. The ends are moved downwardly first as the crushing members 70 and 72 are moved onto the can. After the ends are moved downwardly, they are flattened against the remainder of the can, and the crushing is completed. The handles are then raised and the can is then removed through the slot 25. This may be accomplished by pushing the can sideways from above, or by reaching in through the slot and withdrawing the crushed can.

The invention and its attendant advantages will be understood from the foregoing description and it will be apparent that various changes may be made in the form, construction and arrangements of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims, wherein various portions have been separated for clarity of reading and not for emphasis.

I claim:

1. A crushing device, comprising:

a base member having an area thereof to receive an object to be crushed, a first crushing member having one end pivotally secured to said base member adjacent one end of said area, and a second crushing member having one end pivotally secured to said base member adjacent an end of said area opposite said one end, said crushing members being adapted to be moved on said pivotally secured ends toward said area and into a crushing position in relation to said object, the other ends of said crushing member being adjacent in said crushing position, said crushing members extending over said area in said crushing position, said area being bounded on its said ends by edge members on said base member spaced to receive a predetermined sized can for crushing, the can being adapted to be positioned on its side extending longitudinally between said edge members, said crushing members being pivotally secured by hinges, each hinge being spaced from a respective edge member, each crushing member being adjacent a respective edge member outwardly of said area in said crushing position, and said area having an upper surface on which said can is positioned for crushing, said crushing members in said crushing position being spaced from said upper surface.

2. The invention according to claim 1 in which:

each crushing member has an elongated handle for moving its member into and out of said crushing position, said handles being transversely offset, said handles being movable generally parallel to each other and crossing into juxtaposition in said crushing position.

3. The invention according to claim 2 in which:

a hinge mounting strip is positioned adjacent each of said opposite ends of base member, said hinges being secured to respective strips and spaced above and outwardly of said respective edge members.

4. The invention according to claim 3 in which:

end walls extend upwardly from said base member adjacent each of its opposite ends, said handles extending upwardly being adapted to rest on said walls when said crushing members are moved into their non-crushing positions, and a slot in each of said end walls, each slot being adapted to receive one of said handles when said crushing members are moved into their crushing positions.

5. The invention according to claim 4 in which:

side walls extend between said end walls, an upper open end defined by said walls, and a slot extending through one of said side walls defining an opening along said upper surface of said area for removing crushed cans therethrough.

6. The invention according to claim 5 in which:

said crushing members have hard flat surfaces for making crushing contact with said can, the other ends of said crushing members being spaced closely adjacent in the crushing position.

7. A crushing device, comprising:

a base member having an area thereof to receive an object to be crushed, a first crushing member having one end pivotally secured to said base member adjacent one end of said area, a second crushing member having one end pivotally secured to said base member adjacent an end of said area opposite said one end, said crushing members extending substantially over said area and over said object, and said crushing members being adapted to be moved simultaneously on said pivotally secured ends toward said area and into a crushing position to complete the crushing of said object with said simultaneous movement, each of said crushing members having a handle for moving said members into and out of said crushing position, and said handles being adapted to move generally parallel to each other and crossing into juxtaposition in said crushing position.

8. A crushing device, comprising:

a base member having an area bounded on its ends by edge members on said base member spaced to receive a predetermined sized can for crushing, the can being positioned on its side extending longitudinally between said edge members, a pair of crushing members adapted to extend substantially over said area and over said can in said crushing position to substantially cover said area and said can, said crushing members being pivotally secured by hinges, each hinge being spaced from a respective edge member, each crushing member being adjacent a respective edge member outwardly of said area in said crushing position, said area having an upper surface on which said can is positioned for crushing, said crushing members in said crushing position being spaced from said upper surface, and said crushing members being adapted to be moved simultaneously on said pivotally secured ends toward said area and into a crushing position to complete the crushing of said can with said simultaneous movement.

* * * * *